US011631942B2

(12) United States Patent
Obeidat et al.

(10) Patent No.: US 11,631,942 B2
(45) Date of Patent: Apr. 18, 2023

(54) HYBRID ANTENNA WITH POLARIZATION FLEXIBILITY

(71) Applicant: ARRIS Enterprises LLC, Suwanee, GA (US)

(72) Inventors: Khaled Ahmad Obeidat, San Jose, CA (US); Douglas Blake Kough, San Jose, CA (US); Rajesh Koganti, Santa Clara, CA (US)

(73) Assignee: ARRIS Enterprises LLC, Suwanee, GA (US)

( * ) Notice: Subject to any disclaimer, the term of this patent is extended or adjusted under 35 U.S.C. 154(b) by 0 days.

(21) Appl. No.: 17/244,116

(22) Filed: Apr. 29, 2021

(65) Prior Publication Data

US 2021/0351520 A1 Nov. 11, 2021

Related U.S. Application Data

(60) Provisional application No. 63/021,607, filed on May 7, 2020.

(51) Int. Cl.

| | |
|---|---|
| ***H01Q 21/24*** | (2006.01) |
| ***H01Q 5/28*** | (2015.01) |
| ***H01Q 11/14*** | (2006.01) |

(52) U.S. Cl.

CPC ..... *H01Q 21/245* (2013.01); *H01Q 5/28* (2015.01); *H01Q 11/14* (2013.01)

(58) Field of Classification Search

CPC ..... H01Q 1/246; H01Q 5/28; H01Q 21/06; H01Q 21/245; H01Q 21/29; H01Q 3/44; H04B 7/0408; H04B 7/10

See application file for complete search history.

(56) References Cited

U.S. PATENT DOCUMENTS 6,437,740 B1 * 8/2002 De Champlain ..... H01Q 1/125 342/422
2004/0196834 A1 * 10/2004 Ofek ..... H01Q 1/246 370/352

(Continued)

FOREIGN PATENT DOCUMENTS

WO 2008037579 A1 4/2008

OTHER PUBLICATIONS

"Notification of Transmittal of the International Search Report and the Written Opinion of the International Searching Authority, or the Declaration for corresponding International Application No. PCT/US2021/30419, dated Aug. 3, 2021, (16 pages)".

*Primary Examiner* — Ab Salam Alkassim, Jr.
*Assistant Examiner* — Leah Rosenberg
(74) *Attorney, Agent, or Firm* — Steven Stupp; Stewart Wiener

(57) ABSTRACT

An electronic device includes: a first pair of antennas having a first polarization along a first direction in a plane, where the first pair of antennas are spatially offset from each other along a second direction in the plane; and a second pair of antennas having a second polarization along the second direction, where the second pair of antennas are spatially offset from each other along the first direction. During operation, the electronic device may configure switching elements to: select the first pair of antennas and electrically couple the second pair of antennas to ground; or select the second pair of antennas and electrically couple the first pair of antennas to ground. Then, the electronic device may communicate a packet or a frame with a second electronic device via the selected first pair of antennas or the second pair of antennas.

20 Claims, 10 Drawing Sheets

(56) References Cited

U.S. PATENT DOCUMENTS

| | | | | |
|---|---|---|---|---|
| 2005/0162327 | A1* | 7/2005 | Mori | H01Q 9/0442 343/770 |
| 2007/0229385 | A1 | 10/2007 | Deng et al. | |
| 2008/0284654 | A1 | 11/2008 | Burnside et al. | |
| 2011/0148730 | A1* | 6/2011 | Gottl | H01Q 5/28 343/893 |
| 2013/0072125 | A1 | 3/2013 | Yoon et al. | |
| 2013/0207877 | A1 | 8/2013 | Shtrom et al. | |
| 2015/0229026 | A1* | 8/2015 | Lindmark | H01Q 21/24 343/770 |
| 2015/0349418 | A1* | 12/2015 | Patron | H01Q 3/44 343/836 |
| 2016/0233944 | A1 | 8/2016 | Viswanathan | |
| 2017/0188379 | A1* | 6/2017 | Shtrom | H04L 5/0023 |

* cited by examiner

HYBRID ANTENNA WITH POLARIZATION FLEXIBILITY

CROSS REFERENCE TO RELATED APPLICATIONS

This application claims priority under 35 U.S.C. 119(e) to: U.S. Provisional Application Ser. No. 63/021,607, "Hybrid Antenna with Polarization Flexibility," filed on May 7, 2020, by Khaled Ahmad Obeidat, et al., the contents of which are herein incorporated by reference.

FIELD

The described embodiments relate to techniques for communication. Notably, the described embodiments relate to techniques for communicating using a hybrid antenna with polarization flexibility.

BACKGROUND

Many electronic devices are capable of wirelessly communicating with other electronic devices. For example, these electronic devices can include a networking subsystem that implements a network interface for a wireless local area network (WLAN), e.g., a wireless network such as described in the Institute of Electrical and Electronics Engineers (IEEE) 802.11 standard (which is sometimes referred to as 'Wi-Fi'). For example, a wireless network may include an access point that communicates wirelessly with one or more associated electronic devices (which are sometimes referred to as 'clients').

In order to address effects in a communication environment, during wireless communication one or more transmit antennas having different predefined orthogonal polarizations are often used. (which is sometimes referred to as 'polarization diversity'). For example, separate transmit circuits and transmit antennas with horizontal polarization (or parallel to the ground) and vertical polarization (or perpendicular to the ground) may be used, and the transmit antennas may be spatially offset from each other to ensure that they are decorrelated. In principle, the different predefined polarizations of the spatially decorrelated antennas may help ensure that wireless signals from at least one of the antennas are received by a client at a given location in the communication environment.

However, the use of fixed or predefined polarizations may not be optimal for a particular location or deployment geometry of an electronic device. Moreover, the fixed or predefined polarizations typically cannot address dynamic changes in the radio-frequency environment. Consequently, the available polarizations may result in wasted antenna-pattern energy and degraded communication performance.

SUMMARY

In a first group of embodiments, an electronic device is described. This electronic device includes: an interface circuit, a first antenna having a first polarization along a first direction in a plane (such as a horizontal plane), a second antenna having a second polarization along a second direction in the plane, additional antennas having a third polarization disposed distal to the first antenna and the second antenna in the plane, and switching elements that selectively perform one or more of: selecting one or more antennas in the first antenna, the second antenna and the additional antennas, electrically coupling a portion of the first antenna to ground, or electrically coupling a portion of the second antenna to ground. Note that the portion of the first antenna and the portion of the second antenna are selective reflectors for the additional antennas. During operation, the interface circuit provides control signals to the switching elements to perform one or more of: selecting the one or more antennas in the first antenna, the second antenna and the additional antennas, selectively electrically coupling the portion of first antenna to ground, or selectively electrically coupling the portion of the second antenna to ground, where, when electrically coupled to ground, the portion of the first antenna, the portion of the second antenna, or both modify an antenna radiation pattern of the electronic device. Then, the interface circuit communicates, via the selected one or more antennas, a packet or a frame with a second electronic device, where the communication involves transmitting or receiving wireless signals corresponding to the packet or the frame.

Note that the first antenna or the second antenna may include a dipole antenna. Moreover, the first antenna and the second antenna may be electrically coupled, via a subset of the switching elements, to a feed port by vertical parallel plate transmission lines. Furthermore, a given vertical parallel plate transmission line may provide impedance matching (such as a balun) for a given one of the first antenna or the second antenna. Additionally, the given vertical parallel plate transmission line may be a given one of the reflectors.

In some embodiments, the first direction is perpendicular to the second direction. Moreover, the first polarization or the second polarization may be a horizontal polarization, and the third polarization may be a vertical polarization.

Furthermore, the first antenna, the second antenna and the additional antennas may include antennas that operate in two bands of frequencies.

Additionally, the additional antennas may include three antennas. Note that at least one of the additional antennas may have a different orientation in the plane from a remainder of the additional antennas.

In some embodiments, the first antenna and the second antenna are tuned to a lower frequency that the additional antennas. When the portion of the first antenna or the portion of the second antenna is selectively electrically coupled to ground, the portion of the first antenna or the portion of the second antenna modifies the antenna radiation pattern by reflecting the wireless signals.

Moreover, a base of the first antenna, the second antenna or a given one of the additional antennas may be coupled to a substrate (such as a printed-circuit board), while a remainder of the first antenna, the second antenna or the given one of the additional antennas may be free-standing.

Furthermore, the switching elements may include a radio-frequency switch. However, the switching elements may exclude a PIN diode.

Another embodiment provides the interface circuit.

Another embodiment provides a computer-readable storage medium with program instructions for use with the electronic device. When executed by the electronic device, the program instructions cause the electronic device to perform at least some of the aforementioned operations in one or more of the preceding embodiments.

Another embodiment provides a method, which may be performed by the electronic device. This method includes at least some of the aforementioned operations in one or more of the preceding embodiments.

In a second group of embodiments, an electronic device is described. This electronic device includes: an interface circuit; a first pair of antennas having a first polarization along a first direction in a plane, where the first pair of antennas are spatially offset from each other along a second direction in the plane; and a second pair of antennas having a second polarization along the second direction, where the second pair of antennas are spatially offset from each other along the first direction. During operation, the electronic device may configure switching elements to: select the first pair of antennas and electrically couple the second pair of antennas to ground; or select the second pair of antennas and electrically couple the first pair of antennas to ground. Note that selecting the first pair of antennas or the second pair of antennas may modify an antenna radiation pattern of the electronic device. Then, the electronic device may communicate with a second electronic device via the selected first pair of antennas or the second pair of antennas, where the communication comprises transmitting or receiving wireless signals corresponding to a packet or a frame.

Note that a given antenna in the first pair of antennas or the second pair of antennas may include a dipole antenna.

Moreover, when selected, the first pair of antennas or the second pair of antennas may be electrically coupled, via a subset of the switching elements, to a feed port by vertical parallel plate transmission lines. Note that a given vertical parallel plate transmission line may provide impedance matching for a given antenna in the first pair of antennas or the second pair of antennas.

Furthermore, the first direction may be perpendicular to the second direction.

Additionally, the first polarization or the second polarization may include a horizontal polarization.

In some embodiments, the electronic device includes a set of first antennas and a set of second antennas. The set of first antennas may include multiple instances of the first pair of antennas, which include the first pair of antennas, and different instances of the first pair of antennas may be spatially offset from each other along the second direction. Moreover, the set of second antennas may include multiple instances of the second pair of antennas, which include the second pair of antennas, and different instances of the second pair of antennas may be spatially offset from each other along the first direction.

Furthermore, the first pair of antennas and the second pair of antennas may operate in two bands of frequencies.

Additionally, a base of a given antenna in the first pair of antennas and the second pair of antennas may be coupled to a substrate, while a remainder of the given antenna may be free-standing.

In some embodiments, the switching elements may include: a radio-frequency switch; or a PIN diode.

Moreover, after selecting the first pair of antennas or the second pair of antennas, the electronic device may further modify the antenna pattern of the electronic device. For example, the further modification may be performed using an adaptive reflector and/or an adaptive director. For example, during the further modification, the adaptive reflector or the adaptive director may be electrically coupled to ground. Alternatively or additionally, the further modification may be performed by selectively electrically coupling antenna elements in a given antenna in the first pair of antennas or the second pair of antennas to ground.

Another embodiment provides the interface circuit.

Another embodiment provides a computer-readable storage medium with program instructions for use with the electronic device. When executed by the electronic device, the program instructions cause the electronic device to perform at least some of the aforementioned operations in one or more of the preceding embodiments.

Another embodiment provides a method, which may be performed by the electronic device. This method includes at least some of the aforementioned operations in one or more of the preceding embodiments.

This Summary is provided for purposes of illustrating some exemplary embodiments, so as to provide a basic understanding of some aspects of the subject matter described herein. Accordingly, it will be appreciated that the above-described features are examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE FIGURES

Note that like reference numerals refer to corresponding parts throughout the drawings. Moreover, multiple instances of the same part are designated by a common prefix separated from an instance number by a dash.

DETAILED DESCRIPTION

Figure 1:
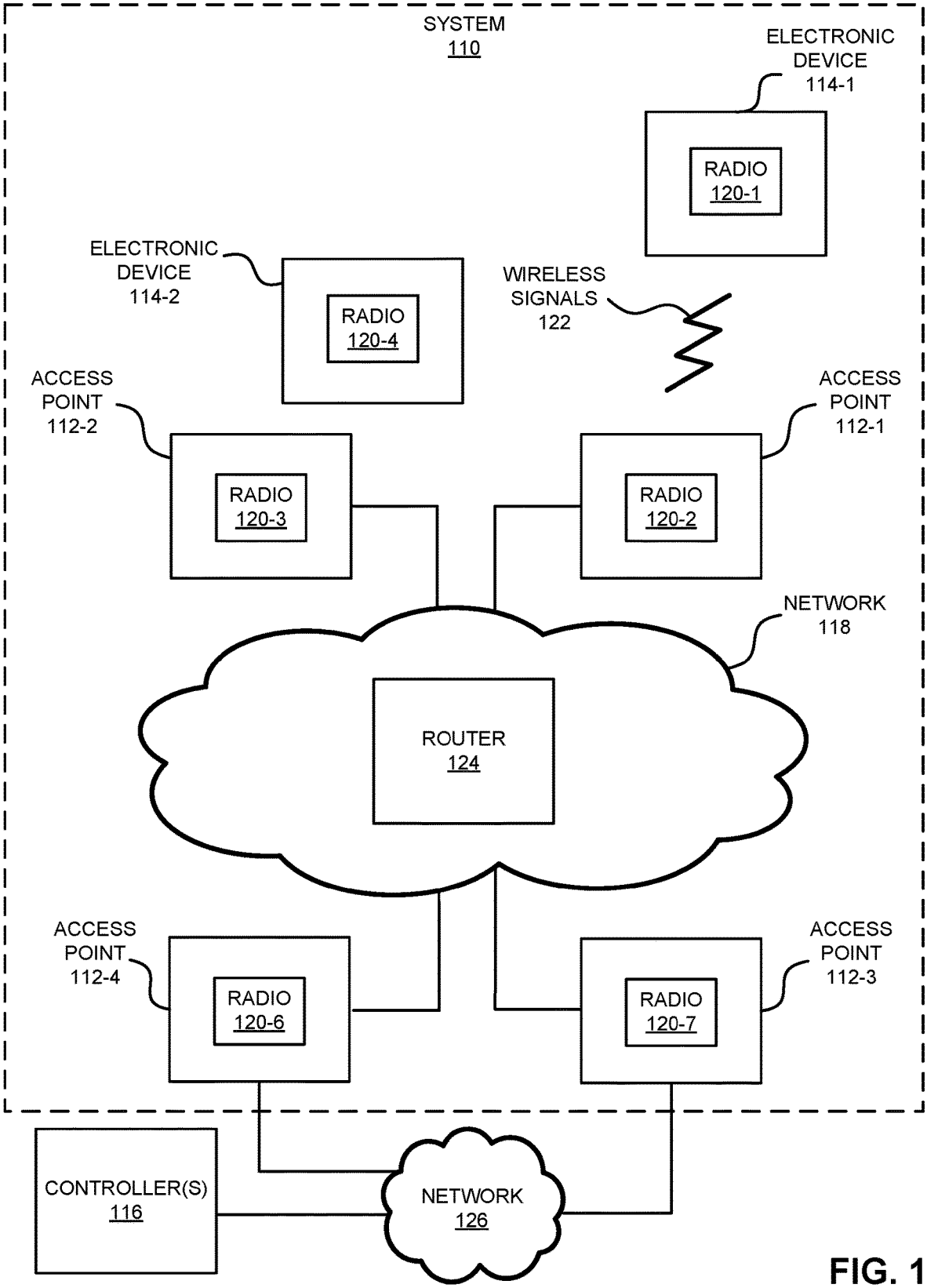
FIG. 1 is a block diagram illustrating an example of communication among electronic devices in accordance with an embodiment of the present disclosure.

In a first group of embodiments, an electronic device is described. This electronic device includes: an interface circuit, antennas having different horizontal polarizations, additional antennas having vertical polarizations disposed distal to the antennas, and switching elements. Note that a portion of the given antenna is a selective reflector for the additional antennas. During operation, the interface circuit provides control signals to the switching elements to perform one or more of: selecting one or more of the antennas and the additional antennas, or selectively electrically coupling a portion of a given one of the antennas to ground, where, when electrically coupled to ground, the portion of the portion of the given antenna modifies an antenna radiation pattern of the electronic device. Then, the interface circuit communicates, via the selected one or more of the antennas and the additional antennas, a packet or a frame with a second electronic device, where the communication involves transmitting or receiving wireless signals corresponding to the packet or the frame.

In a second group of embodiments, an electronic device is described. This electronic device includes: a first pair of antennas having a first polarization along a first direction in a plane, where the first pair of antennas are spatially offset from each other along a second direction in the plane; and a second pair of antennas having a second polarization along the second direction, where the second pair of antennas are spatially offset from each other along the first direction. During operation, the electronic device may configure switching elements to: select the first pair of antennas and electrically couple the second pair of antennas to ground; or select the second pair of antennas and electrically couple the first pair of antennas to ground. Note that selecting the first pair of antennas or the second pair of antennas may modify an antenna radiation pattern of the electronic device. Then, the electronic device may communicate with a second electronic device via the selected first pair of antennas or the second pair of antennas, where the communication comprises transmitting or receiving wireless signals corresponding to a packet or a frame.

By dynamically modifying the polarization of the wireless signals and/or an antenna radiation pattern of the selected one or more antennas (or pairs of antennas) and/or the additional antennas, these communication techniques may allow the electronic device to adapt to different environmental conditions. Notably, the antenna radiation pattern and/or the polarization of the wireless signals transmitted or received by the selected one or more of the antennas and/or the additional antennas may be modified based at least in part on a deployment geometry, such as a location of the electronic device in an environment (such as a building) and the geometry of the surrounding environment proximate to the electronic device. Moreover, the antenna radiation pattern and/or the polarization of the wireless signals may be modified based at least in part on dynamic changes in a radio-frequency environment, such as a location of the second electronic device. Thus, the additional degree of freedom provided by the antennas and the additional antennas may allow the polarization of the wireless signals and/or the antenna radiation pattern to be modified in order to improve or optimize the use of the antenna-pattern energy. Consequently, the communication techniques may improve (or optimize) the communication performance (such as the throughput) with the second electronic device, and therefore may improve the user experience when using the electronic device or the second electronic device.

In the discussion that follows, electronic devices or components in a system communicate packets in accordance with a wireless communication protocol, such as: a wireless communication protocol that is compatible with an IEEE 802.11 standard (which is sometimes referred to as 'WiFi®', from the Wi-Fi Alliance of Austin, Tex.), Bluetooth® (from the Bluetooth Special Interest Group of Kirkland, Wash.), and/or another type of wireless interface (such as another wireless-local-area-network interface). For example, an IEEE 802.11 standard may include one or more of: IEEE 802.11a, IEEE 802.11b, IEEE 802.11g, IEEE 802.11-2007, IEEE 802.11n, IEEE 802.11-2012, IEEE 802.11-2016, IEEE 802.11ac, IEEE 802.11ax, IEEE 802.11ba, IEEE 802.11be, or other present or future developed IEEE 802.11 technologies. Moreover, an access point in the system may communicate with a controller or services using a wired communication protocol, such as a wired communication protocol that is compatible with an Institute of Electrical and Electronics Engineers (IEEE) 802.3 standard (which is sometimes referred to as 'Ethernet'), e.g., an Ethernet II standard. However, a wide variety of communication protocols may be used in the system, including wired and/or wireless communication. In the discussion that follows, Ethernet and Wi-Fi are used as illustrative examples.

We now describe some embodiments of the communication techniques. FIG. 1 presents a block diagram illustrating an example of a system 110, which may include components, such as: one or more access points 112, one or more electronic devices 114 (such as cellular telephones, stations, another type of electronic device, etc.), and one or more optional controllers 116. In system 110, the one or more access points 112 may wirelessly communicate with the one or more electronic devices 114 using wireless communication that is compatible with an IEEE 802.11 standard. Thus, the wireless communication may occur in a 2.4 GHz, a 5 GHz, a 6 GHz and/or a 60 GHz frequency band. (Note that IEEE 802.11ad communication over a 60 GHz frequency band is sometimes referred to as 'WiGig.' In the present discussion, these embodiments also encompassed by 'Wi-Fi.') However, a wide variety of frequency bands may be used.

Moreover, wired and/or wireless communication among access points 112 in a WLAN may occur via network 118 (such as an intra-net, a mesh network, point-to-point connections and/or the Internet) and may use a network communication protocol, such as Ethernet. This network may include one or more routers and/or switches, such as router 124.

As noted previously, the one or more access points 112 and the one or more electronic devices 114 may communicate via wireless communication. Notably, one or more of access points 112 and one or more of electronic devices 114 may wirelessly communicate while: transmitting advertising frames on wireless channels, detecting one another by scanning wireless channels, exchanging subsequent data/management frames (such as association requests and responses) to establish a connection, configure security options (e.g., Internet Protocol Security), transmit and receive frames or packets via the connection (which may include the association requests and/or additional information as payloads), etc.

In some embodiments, the wired and/or wireless communication among access points 112 also involves the use of dedicated connections, such as via a peer-to-peer (P2P) communication technique. Therefore, access points 112 may support wired communication within the WLAN (such as Ethernet) and wireless communication within the WLAN (such as Wi-Fi), and one or more of access points 112 may also support a wired communication protocol (such as Ethernet) for communicating via network 126 (such as the Internet) with other electronic devices, such as a computer or the one or more optional controllers 116 of the WLAN. Note that the one or more optional controllers 116 may be at the same location as the other components in system 110 or may be located remotely (i.e., at a different location). Moreover, note that the one or more access points 112 may be managed by the one or more optional controllers 116. Furthermore, note that the one or more access points 112 may be a physical access point or a virtual or 'software' access point that is implemented on a computer or an electronic device.

Figure 10:
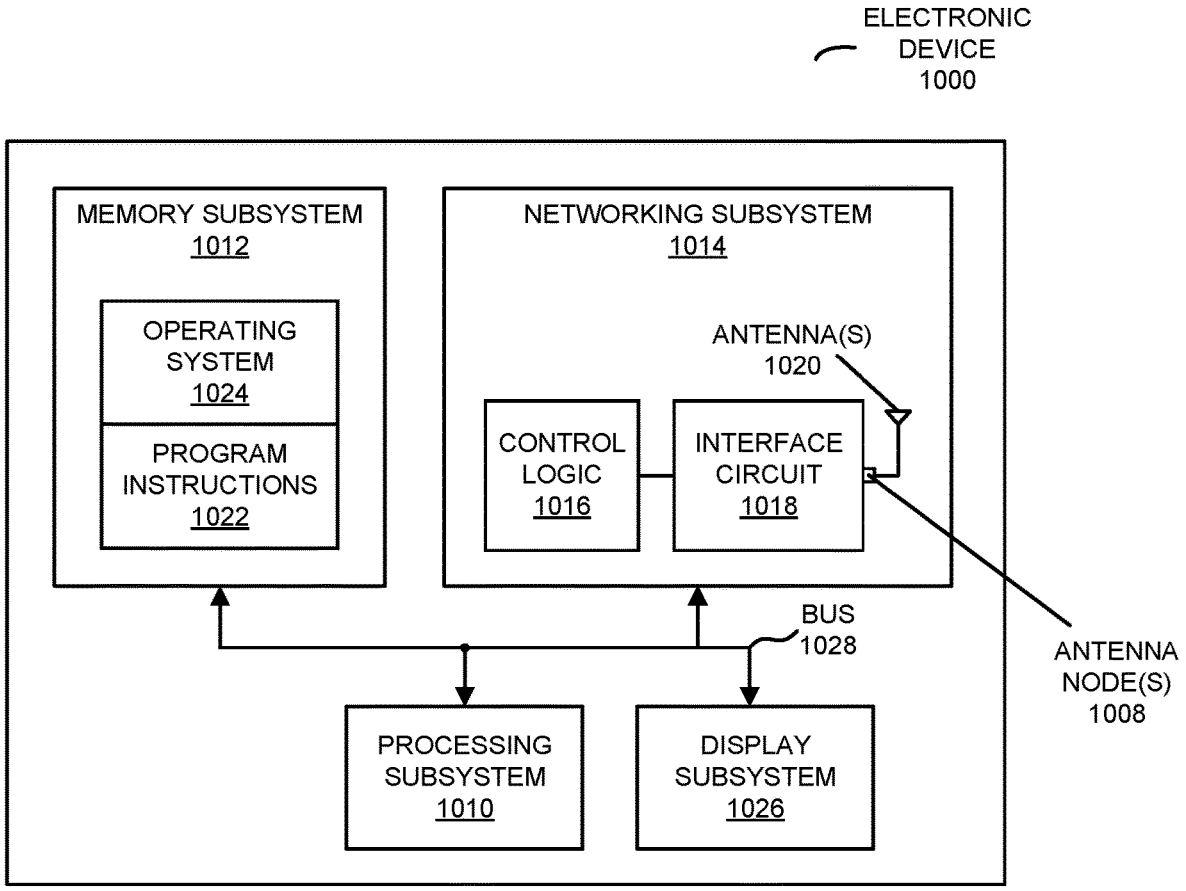
FIG. 10 is a block diagram illustrating an example of an electronic device in accordance with an embodiment of the present disclosure.

As described further below with reference to FIG. 10, the one or more access points 112, the one or more electronic devices 114 and/or the one or more optional controllers 116 may include subsystems, such as a networking subsystem, a memory subsystem and a processor subsystem. In addition, the one or more access points 112 and the one or more electronic devices 114 may include radios 120 in the networking subsystems. More generally, the one or more access points 112 and the one or more electronic devices 114 can include (or can be included within) any electronic devices with the networking subsystems that enable the one or more access points 112 and the one or more electronic devices 114 to wirelessly communicate with each other.

As can be seen in FIG. 1, wireless signals 122 (represented by a jagged line) are transmitted from a radio 120-2 in at least one of the one or more access points 112, such as access point 112-1. These wireless signals are received by radio 120-1 in electronic device 114-1. In particular, access point 112-1 may transmit frames or packets. In turn, these frames or packets may be received by electronic device 114-1. This may allow access point 112-1 to communicate information to electronic device 114-1. Note that the communication between electronic device 114-1 and access point 112-1 may be characterized by a variety of performance metrics, such as: a data rate, a data rate for successful communication (which is sometimes referred to as a 'throughput'), an error rate (such as a retry or resend rate), a mean-square error of equalized signals relative to an equalization target, intersymbol interference, multipath interference, a signal-to-noise ratio, a width of an eye pattern, a ratio of number of bytes successfully communicated during a time interval (such as 1-10 s) to an estimated maximum number of bytes that can be communicated in the time interval (the latter of which is sometimes referred to as the 'capacity' of a communication channel or link), and/or a ratio of an actual data rate to an estimated data rate (which is sometimes referred to as 'utilization'). While instances of radios 120 are shown in the one or more electronic devices 114 and the one or more access points 112, one or more of these instances may be different from the other instances of radios 120.

As noted previously, the polarization of transmitted or received wireless signals are often constrained by the available predefined polarizations of antennas or antenna elements. However, these polarizations may not be well suited for a particular location or environment where an electronic device is deployed. This can result in wasted antenna-pattern energy and degraded communication performance.

In order to address this challenge, the one or more access points 112 (such as access point 112-1) may implement or use the communication techniques. Notably, as discussed further below with reference to FIGS. 2-9, during the communication techniques access point 112-1 may communicate a packet or a frame (e.g., to electronic device 114-1) using wireless signals. The wireless signals may be transmitted by one or more dynamically selected antennas in access point 112-1 that have associated predefined polarizations. Alternatively, access point 112-1 may receive, using the same or different antenna(s), wireless signals corresponding to a packet or a frame (e.g., from electronic device 114-1). Note that in some embodiments, access point 112-1 may communicate the packet or the frame using MIMO. For example, access point 112-1 may use 2×2, 4×4, 8×8, 16×16 or N×N (where N is an integer) MIMO.

Figure 4:
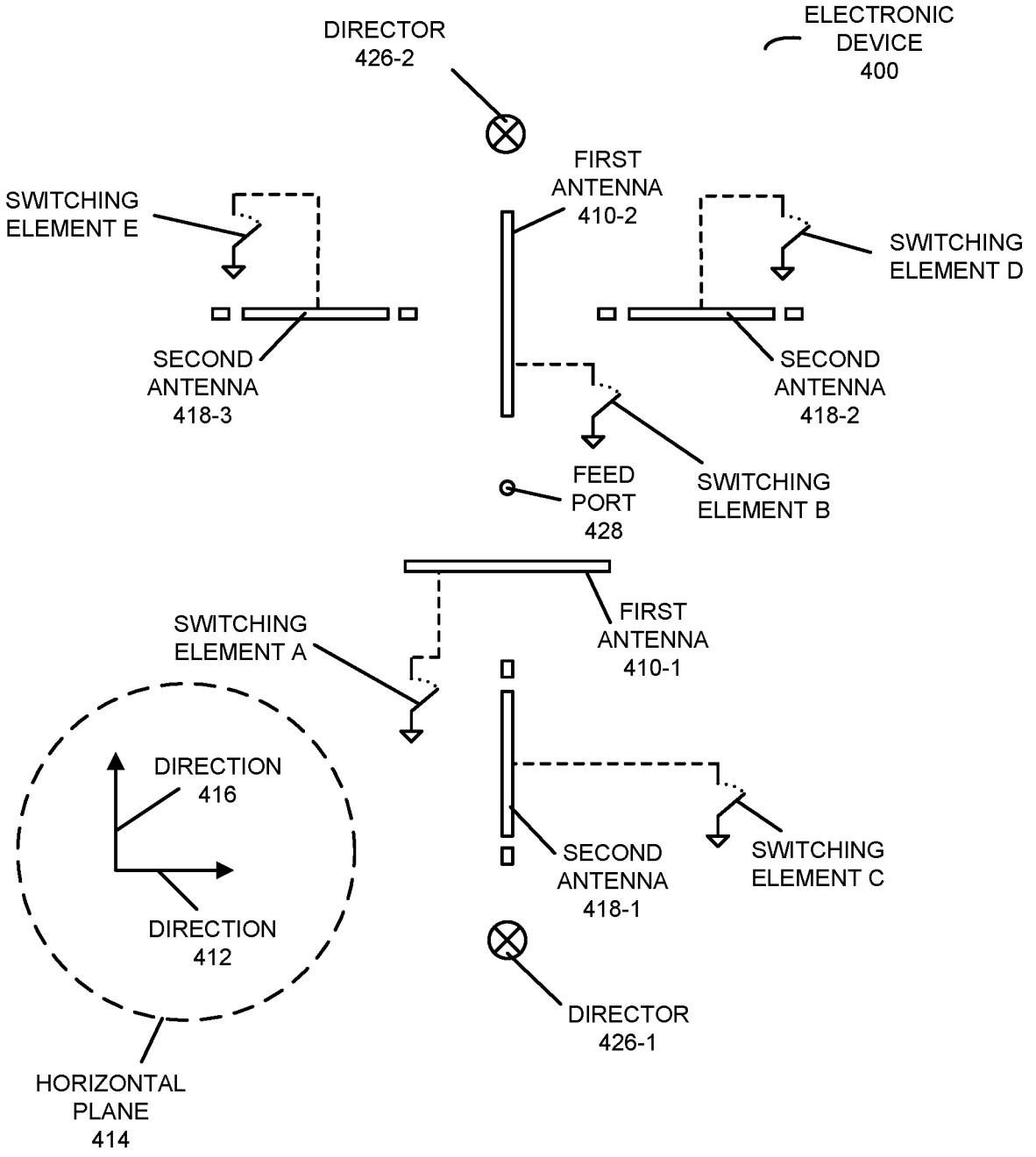
FIG. 4 is a drawing illustrating an example of a top view of antennas in an electronic device having a dynamically adjustable polarization in accordance with an embodiment of the present disclosure.

The antenna(s) may be selected in order to dynamically adjust or modify the polarization of the transmitted or the received wireless signals. For example, antennas having different vertical and/or horizontal polarizations, and/or different orientations may be dynamically selected. Notably, as shown in FIG. 4 (which presents an example of a top view of antennas), an electronic device 400 may include: a first antenna 410-1 having a horizontal polarization along a direction 412 in a horizontal plane 414, a first antenna 410-2 having a horizontal polarization along a direction 416 in horizontal plane 414, and second antennas 418 (such as, e.g., three antennas, which are sometimes referred to as 'additional antennas') having a vertical polarization disposed distal to the first antennas 410 in horizontal plane 414. Note that directions 412 and 416 may be perpendicular to each other. Moreover, note that at least one of the second antennas 418 (such as second antenna 418-1) may have a different orientation in the horizontal plane 414 from a remainder of the second antennas 418. For example, the second antenna 418-1 may be orientated along direction 416 that is perpendicular to the orientations of second antennas 418-2 and 418-3, which are oriented along direction 412.

Figure 6:
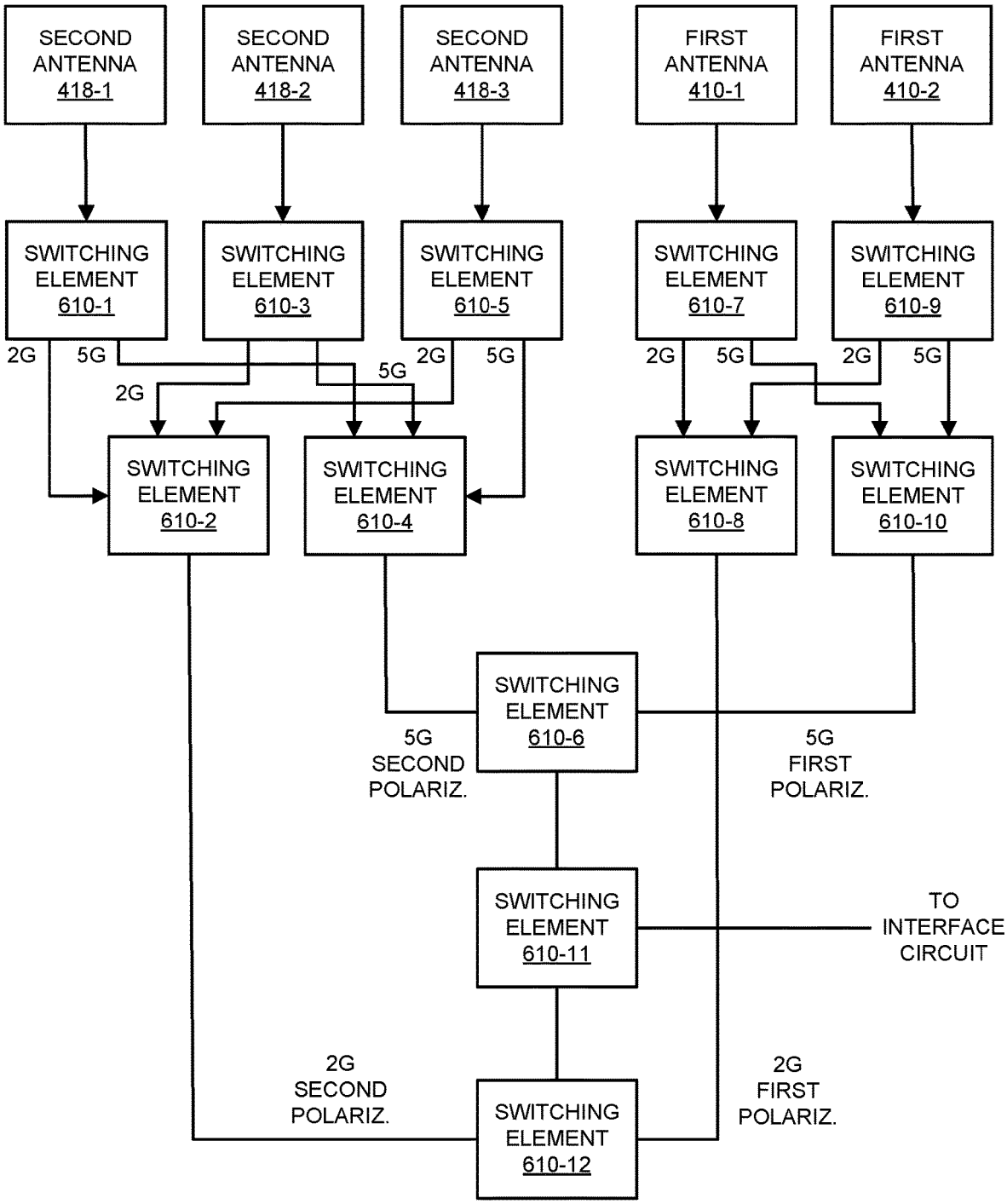
FIG. 6 is a drawing illustrating an example of an electronic device having a dynamically adjustable polarization in accordance with an embodiment of the present disclosure.

Furthermore, as shown in FIG. 6, electronic device 400 may include switching elements 610 (such as a GaAs FET, a MEMS switch or a radio-frequency switch) that selectively perform one or more of: selecting one or more antennas in the first antenna 410-1, the first antenna 410-2 and/or the second antennas 418, electrically coupling (or decoupling) a portion of the first antenna 410-1 to ground or a ground plane, and/or electrically coupling (or decoupling) a portion of the first antenna 410-2 to ground or a ground plane. In some embodiments, switching elements 610-1, 610-3, 610-5, 610-7, 610-9 and 610-11 are diplexers, switching elements 610-2 and 610-4 are single-pole, triple-throw switches and switching elements 610-6, 610-8, 610-10 and 610-12 are single-pole, double-throw switches. In the present discussion, note that electrical coupling to ground may include a DC electrical connection.

Figure 2:
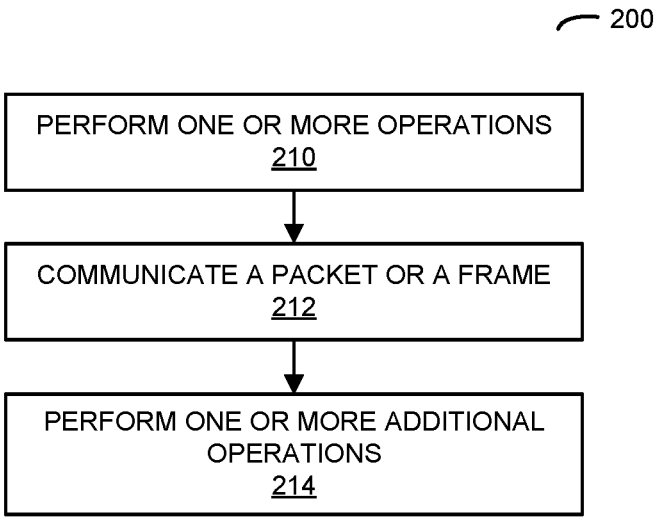
FIG. 2 is a flow diagram illustrating an example of a method for communicating a packet or a frame in accordance with an embodiment of the present disclosure.

As described further below with reference to FIGS. 2 and 3, during operation, electronic device 400 (such as an interface circuit, e.g., radio 120-2 in FIG. 1) may provide control signals to switching elements 610 to perform one or more of: selecting the one or more antennas, selectively electrically coupling (or decoupling) the portion of the first antenna 410-1 to ground or a ground plane, and/or selectively electrically coupling (or decoupling) the portion of the first antenna 410-2 to ground or a ground plane. Note that, the first antenna 410-1, the first antenna 410-2, and/or the second antennas 418 may operate in two bands of frequencies (such as 2.4 and/or 5 GHz bands of frequencies, e.g., at a given time, a given antenna may transmit or receive in either or both bands of frequencies). Moreover, note that the portion of the first antenna 410-1 and/or the portion of the first antenna 410-2 may be selective reflectors for the second antennas 418. When electrically coupled to ground or a ground plane, the portion of the first antenna 410-1 and/or the portion of the first antenna 410-2 may modify an antenna radiation pattern of the electronic device.

Figure 5:
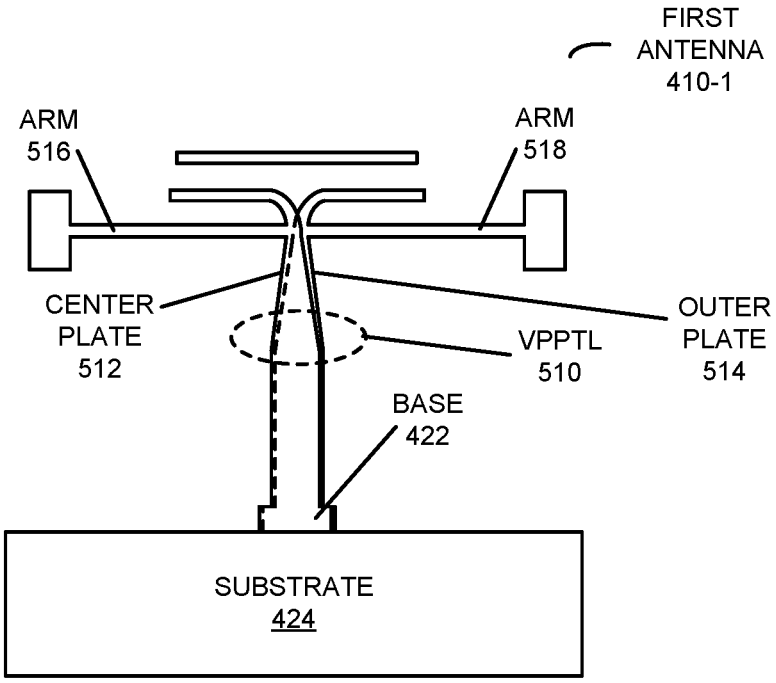
FIG. 5 is a drawing illustrating a side view of an example of antennas in the electronic device of FIG. 4 in accordance with an embodiment of the present disclosure.
Figure 5:
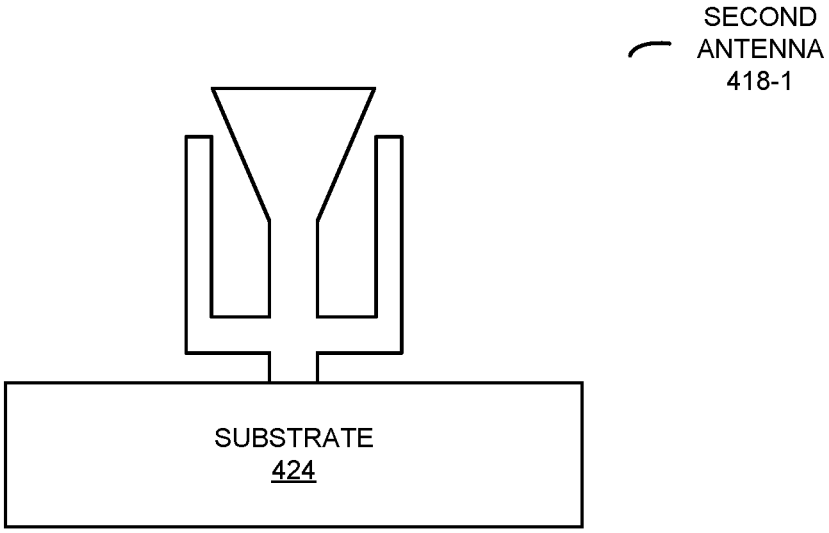

As shown in FIG. 5 (which presents a side view of examples of antennas, such as the first antenna 410-1 and the second antenna 418-1), the first antenna 410-1 may include a dipole antenna. Moreover, first antennas 410 in electronic device 400 (FIGS. 4 and 5) may be electrically coupled, via a subset of switching elements 610 (FIG. 6) and a coaxial cable, to a radio-frequency feed port 428 (FIG. 4) from the interface circuit (such as radio 120-2 in FIG. 1) by vertical parallel plate transmission lines, such as vertical parallel plate transmission line (VPPTL) 510. For example, a center metal plate 512 in the vertical parallel plate transmission line 510 may be coupled or connected to one arm 516 of a dipole antenna, and an outer metal plate 514 (some of which is below the center metal plate) in the vertical parallel plate transmission line 510 may be coupled or connected to another arm 518 of the dipole antenna. Furthermore, a base 422 of the first antenna 410-1 may be coupled to a substrate 424 (such as a printed-circuit board), while a remainder of the first antenna 410-1 may be free-standing. However, in some embodiments, the first antenna 410-1, the first antenna 410-2 and the second antennas 418 may be disposed on different substrates (not shown), at least some of which may have different orientations from each other.

Additionally, the vertical parallel plate transmission line 510 may provide impedance matching (such as a balun that converts an unbalanced electrical signal to a balanced electrical signal) for the first antenna 410-1 and the second antenna 418-1. Note that a given vertical parallel plane transmission line may have a length of a quarter of a wavelength corresponding to a center frequency of a given antenna.

Because of a ground plane in substrate 424, the first antenna 410-1 may have a peanut-shaped antenna radiation pattern with a symmetry axis along direction 412. Moreover, the vertical parallel plate transmission line 510 in the first antenna 410-1 may be a given one of the reflectors for the second antennas 418. Consequently, the second antenna 418-1 may have an antenna radiation pattern that is concentrated in one half of horizontal plane 414, such as a strands antenna radiation pattern between 0 and 0 and 180°.

In some embodiments, the first antennas 410 are tuned to resonate at a lower frequency that second antennas 418. For example, the first antennas 410 may be tuned to a frequency that is offset by 0.1-0.2× of a carrier or center frequency of the second antennas 418. When the portion of the first antenna 410-1 and/or the portion of the first antenna 410-2 is selectively electrically coupled to ground or a ground plane, the portion of the first antenna 410-1 and/or the portion of the first antenna 410-2 modifies an antenna radiation pattern of electronic device 400 by reflecting wireless signals, e.g., by making the antenna radiation pattern more directional in an opposite direction from the given reflector (such as an antenna radiation pattern that is more directional than an omnidirectional antenna radiation pattern). Alternatively, when the given reflector is decoupled from ground or a ground plane, it may not modify the antenna radiation pattern appreciably.

Referring back to FIG. 4, in some embodiments electronic device 400 may include one or more optional directors 426 proximate to the first antennas 410. Note that the one or more optional directors 426 may be tuned to resonate at a higher frequency than the first antennas 410. For example, a given optional director may have a length that is 0.9-0.95× a length of a given one of the first antennas 410. Moreover, the given optional director may be implemented using metal disposed behind a monopole or a dipole. When the given optional director is selectively electrically decoupled from ground or a ground plane, the given optional director may re-radiate the wireless signals in order to modify the antenna radiation pattern, e.g., by making the antenna radiation pattern more directional in the direction of the given optional director than an unmodified antenna radiation pattern of electronic device 400. Alternatively, when the given optional director is selectively electrically coupled to ground or a ground plane, it may not modify the antenna radiation pattern appreciably.

Referring back to FIG. 1, in some embodiments the selected one or more antennas (and, thus, the selected polarization) is based at least in part on a deployment geometry, location or an environment of access point 112-1. (Consequently, access point 112-1 may have 'polarization flexible antenna'.) Alternatively, the selected polarization may be based at least in part on feedback received from electronic device 114-1. For example, electronic device 114-1 may determine one or more communication-performance metrics (such as throughput, a received signal strength indicator, a signal-to-noise ratio or another communication-performance metric) associated with the packet or the frame received from access point 112-1. Then, electronic device 114-1 may provide the feedback (such as an acknowledgment) corresponding to or that includes the one or more communication-performance metrics (such as information specifying the one or more communication-performance metrics) to access point 112-1. Note that the selection of the polarization may be performed on the fly (such as when the packet or the frame is communicated) and/or may be performed on a device-specific basis (such as for electronic device 114-1)

In some embodiments, radio 120-2 dynamically adjusts the transmit or receive polarization by changing a relative magnitude and/or phase of electrical signals corresponding to the wireless signals (e.g., using a filter and/or a phase-modification element, such as a tapped delay line, between radio 120-2 and one of the first antennas 410 and/or the second antennas 418 in FIG. 4), which, for transmission, are used to drive the selected one or more antennas or antenna elements, or which, for reception, are received by the selected one or more antennas or antenna elements.

As noted previously, in some embodiments the transmit and/or receive polarization is dynamically adjusted based at least in part on feedback (such as an acknowledgment, information specifying a throughput, information specifying a received signal strength indicator, information specifying a signal-to-noise ratio or, more generally, a communication-performance metric) associated with electronic device 114-1. Note that the dynamic adjustment may be performed on the fly (such as when the packet or the frame is communicated) and/or may be performed on a device-specific basis (such as for electronic device 114-1). Consequently, access point 112-1 may use an arbitrary polarization (linear, e.g., horizontal, vertical or any slant, circular or elliptical) to transmit and/or receive the packet or the frame.

Figure 7:
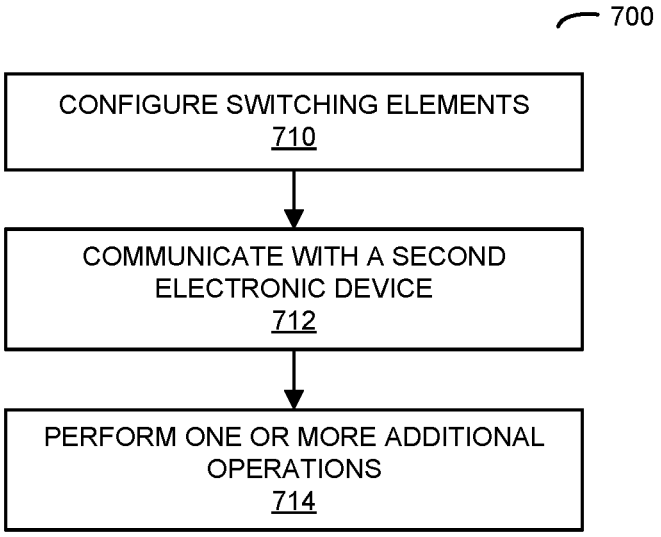
FIG. 7 is a flow diagram illustrating an example of a method for communicating a packet or a frame in accordance with an embodiment of the present disclosure.

As described further below with reference to FIG. 7-9, in some embodiments of the communication techniques, pairs of antennas may be selected in order to dynamically adjust or modify the polarization of the transmitted or the received wireless signals. Notably, an electronic device (such as access point 112-1) may include: a first pair of antennas having a first polarization along a first direction in a plane, where the first pair of antennas are spatially offset from each other along a second direction in the plane; and a second pair of antennas having a second polarization along the second direction, where the second pair of antennas are spatially offset from each other along the first direction. For example, the first direction may be perpendicular to the second direction. Moreover, the first polarization or the second polarization may include a horizontal polarization.

During operation, access point 112-1 (such as radio 120-2) may configure switching elements to: select the first pair of antennas and electrically couple the second pair of antennas to ground; or select the second pair of antennas and electrically couple the first pair of antennas to ground. Note that selecting the first pair of antennas or the second pair of antennas may modify an antenna radiation pattern of electronic device 900. Then, access point 112-1 may communicate with electronic device 114-1 via the selected first pair of antennas or the second pair of antennas, where the communication comprises transmitting or receiving wireless signals corresponding to a packet or a frame.

After selecting the first pair of antennas or the second pair of antennas, access point 112-1 may further modify the antenna pattern of the electronic device. For example, access point 112-1 may use a beamflex technique (which is described further below with reference to FIG. 10) and/or beamforming. Notably, access point 112-1 may perform the further modification using an adaptive reflector and/or an adaptive director. In some embodiments, during the further modification, the adaptive reflector or the adaptive director may be electrically coupled to ground. Alternatively or additionally, the further modification may be performed by selectively electrically coupling antenna elements in a given antenna in the first pair of antennas or the second pair of antennas to ground.

Note that a given antenna in the first pair of antennas or the second pair of antennas may include a dipole antenna. Moreover, when selected, the first pair of antennas or the second pair of antennas may be electrically coupled, via a subset of the switching elements, to a feed port by vertical parallel plate transmission lines. A given vertical parallel plate transmission line may provide impedance matching for a given antenna in the first pair of antennas or the second pair of antennas. Furthermore, the first pair of antennas and the second pair of antennas may operate in two bands of frequencies. Additionally, a base of a given antenna in the first pair of antennas and the second pair of antennas may be coupled to a substrate, while a remainder of the given antenna may be free-standing.

In some embodiments, access point 112-1 includes a set of first antennas and a set of second antennas. The set of first antennas may include multiple instances of the first pair of antennas, which include the first pair of antennas, and different instances of the first pair of antennas may be spatially offset from each other along the second direction. Moreover, the set of second antennas may include multiple instances of the second pair of antennas, which include the second pair of antennas, and different instances of the second pair of antennas may be spatially offset from each other along the first direction. Note that the switching elements may include: a radio-frequency switch, a MEMS switch, or a PIN diode.

In this way, the communication techniques may allow different polarizations and/or antenna radiation patterns to be obtained even with a set of one or more available antennas having predefined polarizations (such as one or more pairs of antennas). Moreover, the communication techniques may allow the polarization and/or the antenna radiation patterns of the transmitted or received wireless signals at access point 112-1 to be customized to a particular environment, deployment geometry or location and/or based at least in part on a dynamic communication environment. Consequently, the communication techniques may improve (or optimize) the communication performance (such as the throughput) with electronic device 114-1, and therefore may improve the user experience in system 110.

In the described embodiments, processing a frame or a packet in the electronic devices and/or the one or more access points may include: receiving wireless signals 122 with the frame or packet; decoding/extracting the frame or packet from the received wireless signals 122 to acquire the frame or packet; and processing the frame or packet to determine information contained in the frame or packet.

Although we describe the network environment shown in FIG. 1 as an example, in alternative embodiments, different numbers or types of electronic devices or components may be present. For example, some embodiments comprise more or fewer electronic devices or components. Therefore, in some embodiments there may be fewer or additional instances of at least some of the one or more access points 112, the one or more electronic devices 114, and/or the one or more optional controllers 116. As another example, in another embodiment, different electronic devices are transmitting and/or receiving frames or packets.

We now describe embodiments of the method. FIG. 2 presents a flow diagram illustrating an example of a method 200 for communicating a packet or a frame. Moreover, method 200 may be performed by an electronic device, such as one of the one or more access points 112 in FIG. 1, e.g., access point 112-1. During operation, the electronic device may perform one or more operations (operation 210), including one or more of: selecting one or more antennas having predefined polarizations, and/or selectively electrically coupling one or more portions of one or more antennas to ground. The one or more operations may dynamically modify a polarization of wireless signals transmitted from or received by the electronic device and/or may dynamically modify an antenna radiation pattern of the one or more selected antennas.

For example, the electronic device may include: a first antenna having a first polarization along a first direction in a plane (such as a horizontal plane), a second antenna having a second polarization along a second direction in the plane, additional antennas having a third polarization disposed distal to the first antenna and the second antenna in the plane, and switching elements that selectively perform the one or more operations (operation 210). Note that the portion of the first antenna and the portion of the second antenna may be selective reflectors for the additional antennas. Moreover, performing the one or more operations (operation 210) may involve providing control signals to the switching elements to perform one or more of: selecting the one or more antennas in the first antenna, the second antenna and the additional antennas, selectively electrically coupling a portion of first antenna to ground, or selectively electrically coupling a portion of the second antenna to ground, where, when electrically coupled to ground, the portion of the first antenna, the portion of the second antenna, or both modify an antenna radiation pattern of the electronic device.

Then, the electronic device may communicate, via the selected one or more antennas, a packet or a frame (operation 212) with a second electronic device, where the communication involves transmitting or receiving wireless signals corresponding to the packet or the frame.

In some embodiments, the electronic device optionally performs one or more additional operations (operation 214). For example, the electronic device may receive feedback associated with the second electronic device, and the selection of the one or more antennas (and, thus, the modification of the polarization of the wireless signals) may be based at least in part on the feedback.

In some embodiments of method 200, there may be additional or fewer operations. Moreover, the order of the operations may be changed, and/or two or more operations may be combined into a single operation.

Figure 3:
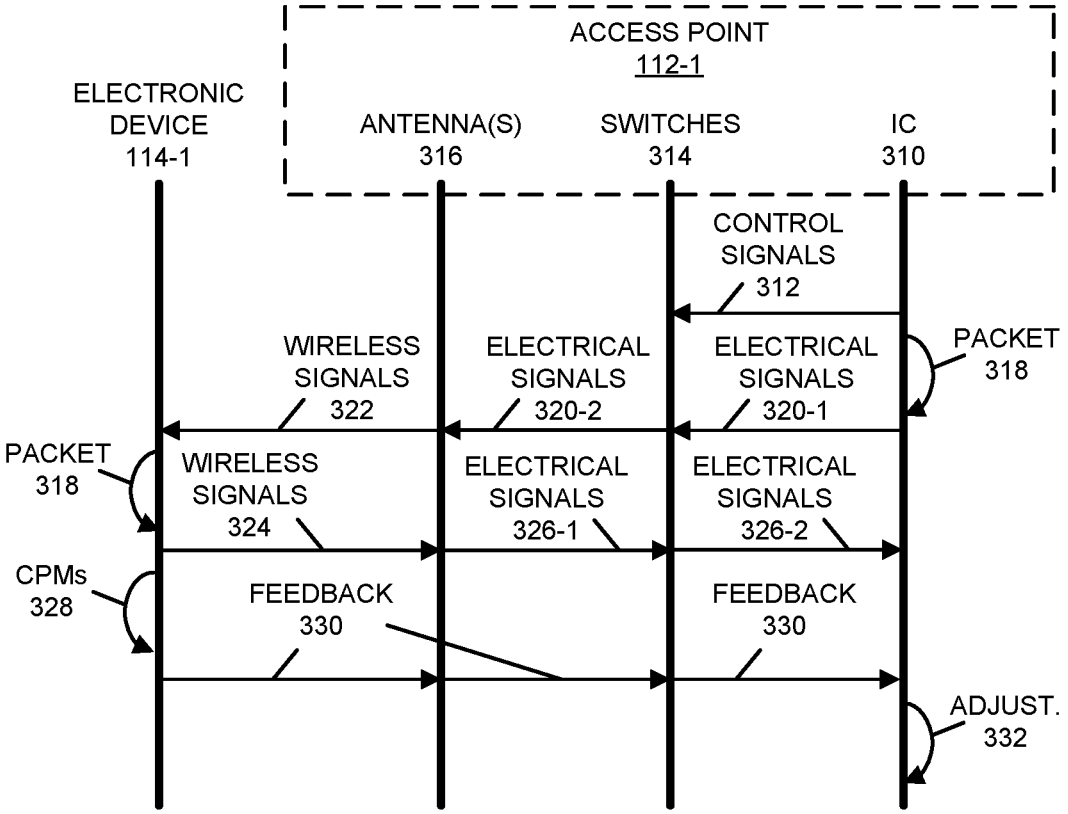
FIG. 3 is a drawing illustrating an example of communication among components in an electronic device in FIG. 1 in accordance with an embodiment of the present disclosure.

Embodiments of the communication techniques are further illustrated in FIG. 3, which presents a drawing illustrating an example of communication between access point 112-1 and electronic device 114-1 according to some embodiments. Notably, interface circuit (IC) 310 in access point 112-1 may provide control signals 312 to one or more switches 314 in access point 112-1. These controls signals may dynamically select one or more antennas 316 in access point 112-1 that have associated predefined polarizations. For example, the one or more antennas 316 may include one or more of: a first antenna having a first polarization along a first direction in a plane (such as a horizontal plane), a second antenna having a second polarization along a second direction in the plane, and additional antennas having a third polarization disposed distal to the first antenna and the second antenna in the plane. By changing states of the one or more switches 314, control signals 312 may dynamically modify or adjust the polarization of wireless signals transmitted or received by access point 112-1.

Moreover, at least some of switches 314 may selectively electrically couple one or more portions of one or more of antennas 316 to ground, so that the one or more portions are reflectors for at least some of the one or more antennas 316. In this way, control signals 312 may dynamically modify or adjust an antenna radiation pattern of the one or more antennas 316.

Then, interface circuit 310 may communicate, via the one or more antennas 314, a packet 318 or a frame with electronic device 114-1. For example, interface circuit 310 may provide electrical signals 320 corresponding to packet 318 to a given one of the one or more antennas 316, which may transmit wireless signals 322 corresponding to packet 318 to electronic device 114-1. Alternatively, electronic device 114-1 may transmit wireless signals 324 corresponding to packet 318 to access point 112-1, which may receive wireless signals 324 using the one or more selected antennas 316, and may provide electrical signals 326 to interface circuit 310.

Note that the dynamic adjustment of the polarization and/or the antenna radiation pattern may be based at least in part on feedback 330 from electronic device 114-1. Notably, after receiving wireless signals 322, electronic device 114-1 may determine one or more communication-performance metrics (CPMs) 328 and then may provide feedback 330 to access point 112-1. This feedback may include an acknowledgment and/or information that specifies the one or more communication-performance metrics (such as a received signal strength, a throughput, etc.). After receiving feedback 330, interface circuit 310 may determine an adjustment 332 to one or more of the antenna radiation pattern and/or the polarization.

While not shown in FIG. 3, access point 112-1 may dynamically modify one or more of antenna radiation patterns and/or the polarization of the wireless signals 324. Note that these modifications or adjustments may be based at least in part on one or more communication-performance metrics associated with the communication of packet 316 from electronic device 114-1, such as one or more communication-performance metrics determined by interface circuit 310.

Moreover, while FIG. 3 illustrates communication between components using unidirectional or bidirectional communication with lines having single arrows or double arrows, in general the communication in a given operation in this figure may involve unidirectional or bidirectional communication.

In some embodiments of the communication techniques, an access point may use the capabilities illustrated in FIGS. 4-6 to dynamically adjust an antenna radiation pattern of the one or more selected antennas and/or a polarization of wireless signals transmitted or received by the one or more selected antennas. These capabilities may allow the creation of antenna-radiation patterns and/or the selection of polarizations that are more suited to the deployed environment or that adapt to a dynamic wireless environment (such as the current location of a client).

The communication techniques may allow the access point to switch between different antenna radiation patterns, as well as specifying the polarization of each antenna radiation pattern (e.g., vertical or horizontal). This capability may be achieved by placing a vertical and a horizontal antenna freely on a substrate, such as a first horizontal antenna and a first vertical antenna as one pair, while a second horizontal antenna and two additional vertical antennas are another pair. Note that a shield-can or components may be placed between the pairs on the substrate.

The antennas may be fabricated using printed-circuit-board technology, stamping, laser-direct structuring and/or a heat-stick fabrication technique. Note that performance and size of the antennas may be traded off against each other.

Moreover, each antenna may have a matching-network circuit. These may be followed by the switching elements, such as diplexers, single-pole, triple-throw switches and/or single-pole, double-throw switches, in order to select the antenna radiation pattern and polarization. However, in other embodiments, the switching elements may be excluded. While the polarization is not configurable in these embodiments, isolation issues may also be reduced or eliminated.

Furthermore, cables may not need to be orientated vertically in order to feed the antennas. This may decrease cross-polarization radiation from the cable common mode. In addition, a support board or substrate (with tens of radio-frequency components) may not be needed to support the antennas in embodiments where the antennas are free-standing.

In some embodiments, PIN diodes may not be used to switch parasitic components (such as reflectors) on or off at high speed. This may reduce the impact on higher-data modulation coding schemes, which may otherwise require a −33 dB or better error vector magnitude (EVM) when switching between, e.g., the 2.4 GHz band or the 5 GHz band of frequencies.

Note that first antennas 410 may, e.g., have, at a center frequency of 2.5 GHz, a radiation efficiency between −0.6 and −0.7 dB, a total efficiency between −1.4 and −1.7 dB, and a directivity between 8.7 and 8.9 dBi. Moreover, second antennas 418 may, e.g., have, at a center frequency of 2.5 GHz, a radiation efficiency between −0.3 and −0.5 dB, a total efficiency between −0.8 and −1.2 dB and a directivity between 5.2 and 6.8 dBi.

Furthermore, first antennas 410 may, e.g., have, at a center frequency of 5.5 GHz, a radiation efficiency between −0.6 and −0.7 dB, a total efficiency between −0.6 and −0.8 dB, and a directivity between 7.8 and 8.1 dBi. Additionally, second antennas 418 may, e.g., have, at a center frequency of 5.5 GHz, a radiation efficiency between −0.1 and −0.2 dB, a total efficiency between −0.3 and −0.4 dB and a directivity between 7.1 and 7.6 dBi.

Note that dynamically changing or adjusting the polarization may not increase a gain of an antenna radiation pattern of the one or more selected antennas. Instead, the dynamically changed or adjusted polarization may reduce or eliminate the effect of a fading null at one polarization and/or a change in the polarization because of reflections.

We now describe other embodiments of the method. FIG. 7 presents a flow diagram illustrating an example of a method 700 for communicating a packet or a frame. Moreover, method 700 may be performed by an electronic device, such as one of the one or more access points 112 in FIG. 1, e.g., access point 112-1. During operation, the electronic device may configure switching elements (operation 710) to: select a first pair of antennas and electrically coupling a second pair of antennas to ground; or select the second pair of antennas and electrically coupling the first pair of antennas to ground. For example, the electronic device may provide control signals to the switching elements. Note that the first pair of antennas may have a first polarization along a first direction in a plane and the first pair of antennas are spatially offset from each other along a second direction in the plane, and the second pair of antennas may have a second polarization along the second direction and the second pair of antennas are spatially offset from each other along the first direction. Moreover, selecting the first pair of antennas or the second pair of antennas modifies an antenna pattern of the electronic device.

Then, the electronic device may communicate with a second electronic device (operation 712) via the selected first pair of antennas or the second pair of antennas, where the communication may include transmitting or receiving wireless signals corresponding to the packet or the frame.

In some embodiments, the electronic device may optionally perform one or more additional operations (operation 714). For example, when selected (operation 710), the first pair of antennas or the second pair of antennas may be electrically coupled, via a subset of the switching elements, to a feed port by vertical parallel plate transmission lines. Note that a given vertical parallel plate transmission line may provide impedance matching for a given antenna in the first pair of antennas or the second pair of antennas.

Moreover, after selecting the first pair of antennas or the second pair of antennas (operation 710), the electronic device may further modify the antenna pattern of the electronic device. For example, the further modification may be performed using an adaptive reflector and/or an adaptive director. For example, during the further modification, the adaptive reflector or the adaptive director may be electrically coupled to ground. Alternatively or additionally, the further modification may be performed by selectively electrically coupling antenna elements in a given antenna in the first pair of antennas or the second pair of antennas to ground. Thus, in some embodiments, the further modification may involve a beamflex technique.

Moreover, a given antenna in the first pair of antennas or the second pair of antennas may include a dipole antenna. Furthermore, the first direction may be perpendicular to the second direction. Additionally, the first polarization or the second polarization may include a horizontal polarization.

In some embodiments, the electronic device includes a set of first antennas and a set of second antennas. The set of first antennas may include multiple instances of the first pair of antennas, which include the first pair of antennas, and different instances of the first pair of antennas may be spatially offset from each other along the second direction. Moreover, the set of second antennas may include multiple instances of the second pair of antennas, which include the second pair of antennas, and different instances of the second pair of antennas may be spatially offset from each other along the first direction.

Furthermore, the first pair of antennas and the second pair of antennas may operate in two bands of frequencies. Additionally, a base of a given antenna in the first pair of antennas and the second pair of antennas may be coupled to a substrate, while a remainder of the given antenna may be free-standing. In some embodiments, the switching elements may include: a radio-frequency switch; or a PIN diode.

Note that the configuring of the switching elements (operation 710), and thus, the modification of the antenna radiation pattern, may be performed dynamically. For example, the selection of the first pair of antennas or the second pair of antennas may be performed infrequently (quasi-static). Alternatively, the selection of the first pair of antennas or the second pair of antennas may be performed on a packet-by-packet or frame-by-frame basis. In some embodiments, the configuring of the switching elements (operation 710) may be based at least in part on feedback computed by the electronic device and/or received from the second electronic device, such as: information specifying one or more communication performance metrics associated with the communication (operation 712); an acknowledgment (such as an acknowledgment that the packet or the frame was received); or the absence of an acknowledgment.

In some embodiments of method 700, there may be additional or fewer operations. Moreover, the order of the operations may be changed, and/or two or more operations may be combined into a single operation.

Figure 8:
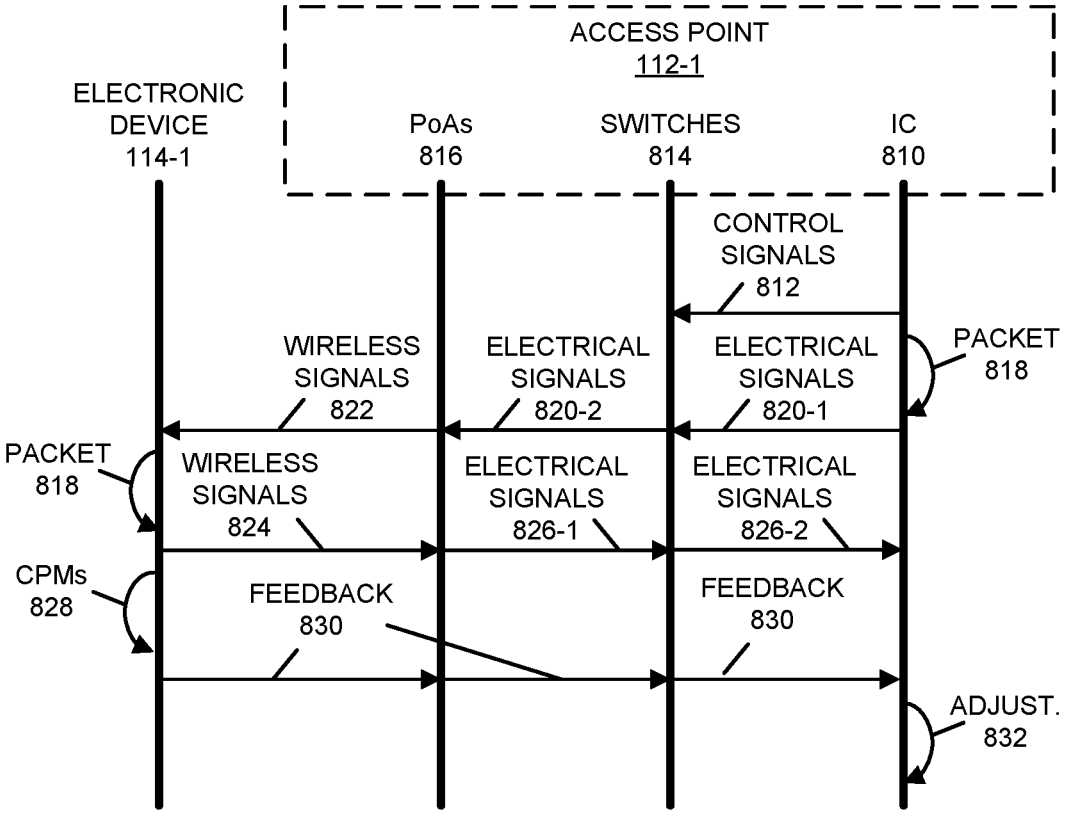
FIG. 8 is a drawing illustrating an example of communication among components in an electronic device in FIG. 1 in accordance with an embodiment of the present disclosure.

Embodiments of the communication techniques are further illustrated in FIG. 8, which presents a drawing illustrating an example of communication between access point 112-1 and electronic device 114-1 according to some embodiments. Notably, interface circuit (IC) 810 in access point 112-1 may provide control signals 812 to one or more switches 814 in access point 112-1. These controls signals may configure switches 814 to dynamically select one or more pairs of antennas (PoAs) 816 in access point 112-1 that have associated predefined polarizations. For example, the one or more pairs of antennas 816 may include: a first pair of antennas having a first polarization along a first direction in a plane and that are spatially offset from each other along a second direction in the plane; and a second pair of antennas having a second polarization along the second direction and that are spatially offset from each other along the first direction. By changing states of the one or more switches 814, control signals 812 may dynamically modify or adjust the polarization of wireless signals transmitted or received by access point 112-1.

Moreover, at least some of switches 814 may selectively electrically couple one or more pairs of antennas 816 to ground. For example, when the first pair of antennas is selected, the second pair of antennas may be electrically coupled to ground. Alternatively, when the second pair of antennas is selected, the first pair of antennas may be electrically coupled to ground. In this way, control signals 812 may dynamically modify or adjust an antenna radiation pattern of the one or more pairs of antennas 816.

Then, interface circuit 810 may communicate, via the one or more pairs of antennas 814, a packet 818 or a frame with electronic device 114-1. For example, interface circuit 810 may provide electrical signals 820 corresponding to packet 818 to the selected first pair of antennas or the selected second pair of antennas, which may transmit wireless signals 822 corresponding to packet 818 to electronic device 114-1. Alternatively, electronic device 114-1 may transmit wireless signals 824 corresponding to packet 818 to access point 112-1, which may receive wireless signals 824 using the selected first pair of antennas or the selected second pair of antennas, and may provide electrical signals 826 to interface circuit 810.

Note that the dynamic adjustment of the polarization and/or the antenna radiation pattern may be based at least in part on feedback 830 from electronic device 114-1. Notably, after receiving wireless signals 822, electronic device 114-1 may determine one or more communication-performance metrics (CPMs) 828 and then may provide feedback 830 to access point 112-1. This feedback may include an acknowledgment and/or information that specifies the one or more communication-performance metrics (such as a received signal strength, a throughput, etc.). After receiving feedback 830, interface circuit 810 may determine an adjustment 832 to one or more of the antenna radiation pattern and/or the polarization.

While not shown in FIG. 8, access point 112-1 may dynamically modify one or more of antenna radiation patterns and/or the polarization of the wireless signals 824. Note that these modifications or adjustments may be based at least in part on one or more communication-performance metrics associated with the communication of packet 816 from electronic device 114-1, such as one or more communication-performance metrics determined by interface circuit 810.

Moreover, while FIG. 8 illustrates communication between components using unidirectional or bidirectional communication with lines having single arrows or double arrows, in general the communication in a given operation in this figure may involve unidirectional or bidirectional communication.

Figure 9:
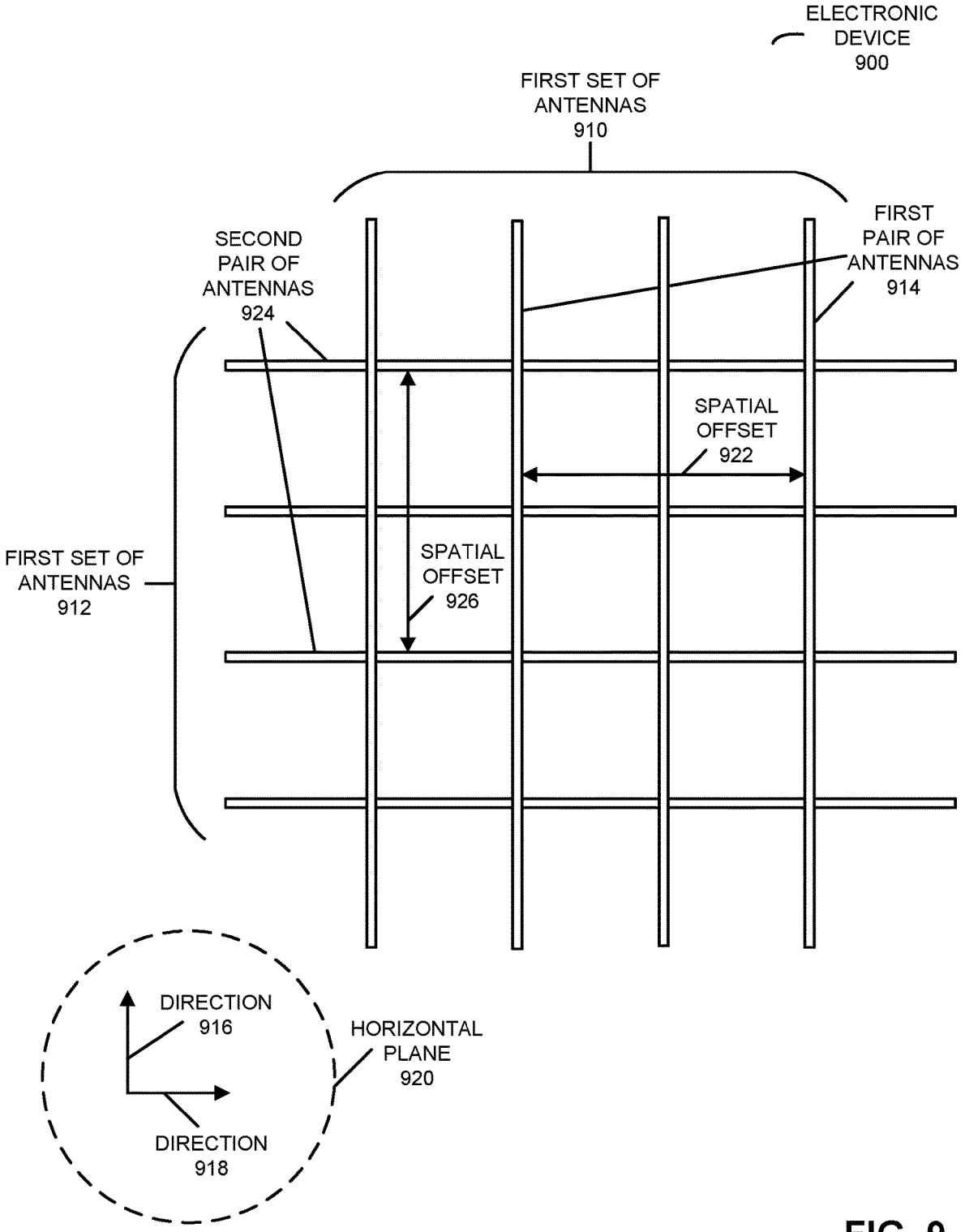
FIG. 9 is a drawing illustrating an example of a top view of antennas in an electronic device having a dynamically adjustable polarization in accordance with an embodiment of the present disclosure.

FIG. 9 presents a drawing illustrating an example of a top view of antennas in an electronic device 900 having a dynamically adjustable polarization in accordance with an embodiment of the present disclosure. Notably, electronic device 900 may include a set of first antennas 910 and a set of second antennas 912. Note that the set of first antennas 910 and the set of second antennas 912 may be arranged in a grid pattern.

Moreover, the set of first antennas 910 may include multiple instances of a first pair of antennas (such as first pair of antennas 914). This first pair of antennas may have a first polarization along a first direction 916 in a plane 920, where the first pair of antennas 914 are spatially offset 922 from each other along a second direction 918 in plane 920. Note that different instances of the first pair of antennas in the set of first antennas 910 may be spatially offset from each other along the second direction 918.

Furthermore, the set of first antennas 912 may include multiple instances of a second pair of antennas (such as second pair of antennas 924). This second pair of antennas may have a second polarization along a second direction 918 in plane 920, where the second pair of antennas 924 are spatially offset 926 from each other along a first direction 916 in plane 920. Note that different instances of the second pair of antennas in the set of second antennas 912 may be spatially offset from each other along the first direction 916.

Additionally, note that the preceding embodiments may include fewer or additional components, two or more components may be combined into a single component, and/or positions of one or more components may be changed.

In some embodiments, a given antenna may be or may include a monopole or a dipole (such as a bent dipole antenna) or a slot antenna. For example, a dipole antenna may have a horizontal polarization and a slot antenna may have a vertical polarization. However, a wide variety of types of antennas and/or antenna elements may be used. The antennas may be free-standing and/or may be implemented on a substrate or a printed-circuit board (e.g., FR4, Rogers 4003, or another dielectric material), such as by using metal or another radio-frequency conducting foil on one side of the substrate and a ground plane on the other (coplanar) side of the substrate. Moreover, one or more additional components may be optionally included on either or both sides of the substrate. Note that the given antenna may have a polarization substantially in a plane of the substrate.

Moreover, the dimensions of the individual components in the given antenna may be established by use of radio-frequency simulation software, such as HFSS (from Ansys, Inc. of Canonsburg, Pa.), CST (from 3DS of Vélizy-Villacoublay, France), FEKO (from Altair Engineering of Troy, Mich.), or IE3D (from Zeland Software of Fremont, Calif.). In some embodiments, the given antenna may include one or more additional components, such as passive components that implement phase or impedance matching, that change a resonance frequency, that broaden the frequency response (or bandwidth), etc. For example, in the 2.4 to 2.4835 GHz band of frequencies, the frequency response of a dipole may be between 300-500 MHz.

Furthermore, switching at radio frequency (as opposed to baseband) may allow the access point to have fewer up/down converters and may simplify impedance matching between the interface circuit and the antennas. For example, a given antenna may provide an impedance match under all configurations of selected antenna elements, regardless of which antenna elements are selected. In some embodiments, a match with less than 10 dB return loss may be maintained under all configurations of selected antenna elements, over the range of frequencies (such as a band of frequencies in an IEEE 802.11 standard), regardless of which antenna elements are selected.

Alternatively or additionally to using antennas or antenna elements to vary the polarization and/or the antenna radiation pattern, in some embodiments the communication techniques may be used in conjunction with beamforming and/or a beamflex technique. Note that the changes in the polarization, the beamforming and/or the beamflex technique may be used during transmission and/or receiving.

We now describe embodiments of an electronic device, which may perform at least some of the operations in the communication techniques. For example, the electronic device may include a component in system 110, such as one of: the one or more access points 112, the one or more electronic devices 114 and/or the one or more optional controllers 116. FIG. 10 presents a block diagram illustrating an electronic device 1000 in accordance with some embodiments. This electronic device includes processing subsystem 1010, memory subsystem 1012, and networking subsystem 1014. Processing subsystem 1010 includes one or more devices configured to perform computational operations. For example, processing subsystem 1010 can include one or more microprocessors, ASICs, microcontrollers, programmable-logic devices, graphical processor units (GPUs) and/or one or more digital signal processors (DSPs).

Memory subsystem 1012 includes one or more devices for storing data and/or instructions for processing subsystem 1010 and networking subsystem 1014. For example, memory subsystem 1012 can include dynamic random access memory (DRAM), static random access memory (SRAM), and/or other types of memory (which collectively or individually are sometimes referred to as a 'computer-readable storage medium'). In some embodiments, instructions for processing subsystem 1010 in memory subsystem 1012 include: one or more program modules or sets of instructions (such as program instructions 1022 or operating system 1024), which may be executed by processing subsystem 1010. Note that the one or more computer programs may constitute a computer-program mechanism. Moreover, instructions in the various program instructions in memory subsystem 1012 may be implemented in: a high-level procedural language, an object-oriented programming language, and/or in an assembly or machine language. Furthermore, the programming language may be compiled or interpreted, e.g., configurable or configured (which may be used interchangeably in this discussion), to be executed by processing subsystem 1010.

In addition, memory subsystem 1012 can include mechanisms for controlling access to the memory. In some embodiments, memory subsystem 1012 includes a memory hierarchy that comprises one or more caches coupled to a memory in electronic device 1000. In some of these embodiments, one or more of the caches are located in processing subsystem 1010.

In some embodiments, memory subsystem 1012 is coupled to one or more high-capacity mass-storage devices (not shown). For example, memory subsystem 1012 can be coupled to a magnetic or optical drive, a solid-state drive, or another type of mass-storage device. In these embodiments, memory subsystem 1012 can be used by electronic device 1000 as fast-access storage for often-used data, while the mass-storage device is used to store less frequently used data.

Networking subsystem 1014 includes one or more devices configured to couple to and communicate on a wired and/or wireless network (i.e., to perform network operations), including: control logic 1016, an interface circuit 1018 and one or more antennas 1020 (or antenna elements). (While FIG. 10 includes one or more antennas 1020, in some embodiments electronic device 1000 includes one or more nodes, such as nodes 1008, e.g., a pad, which can be coupled to the one or more antennas 1020. Thus, electronic device 1000 may or may not include the one or more antennas 1020.) For example, networking subsystem 1014 can include a Bluetooth networking system, a cellular networking system (e.g., a 3G/4G/5G network such as UMTS, LTE, etc.), a USB networking system, a networking system based on the standards described in IEEE 802.11 (e.g., a Wi-Fi networking system), an Ethernet networking system, and/or another networking system.

In some embodiments, a transmit antenna radiation pattern of electronic device 1000 may be adapted or changed using pattern shapers (such as reflectors) in one or more antennas 1020 (or antenna elements), which can be independently and selectively electrically coupled to ground to steer the transmit antenna radiation pattern in different directions (which is sometimes referred to as a 'beamflex technique'). (The antenna-radiation-pattern shapers may be different from the directors and the reflectors discussed previously.) Thus, if one or more antennas 1020 includes N antenna-radiation-pattern shapers, the one or more antennas 1020 may have $2^N$ different antenna-radiation-pattern configurations. More generally, a given antenna radiation pattern may include amplitudes and/or phases of signals that specify a direction of the main or primary lobe of the given antenna radiation pattern, as well as so-called 'exclusion regions' or 'exclusion zones' (which are sometimes referred to as 'notches' or 'nulls'). Note that an exclusion zone of the given antenna radiation pattern includes a low-intensity region of the given antenna radiation pattern. While the intensity is not necessarily zero in the exclusion zone, it may be below a threshold, such as 4 dB or lower than the peak gain of the given antenna radiation pattern. Thus, the given antenna radiation pattern may include a local maximum (e.g., a primary beam) that directs gain in the direction of an electronic device that is of interest, and one or more local minima that reduce gain in the direction of other electronic devices that are not of interest. In this way, the given antenna radiation pattern may be selected so that communication that is undesirable (such as with the other electronic devices) is avoided to reduce or eliminate adverse effects, such as interference or crosstalk.

Networking subsystem 1014 includes processors, controllers, radios/antennas, sockets/plugs, and/or other devices used for coupling to, communicating on, and handling data and events for each supported networking system. Note that mechanisms used for coupling to, communicating on, and handling data and events on the network for each network system are sometimes collectively referred to as a 'network interface' for the network system. Moreover, in some embodiments a 'network' or a 'connection' between the electronic devices does not yet exist. Therefore, electronic device 1000 may use the mechanisms in networking subsystem 1014 for performing simple wireless communication between the electronic devices, e.g., transmitting frames and/or scanning for frames transmitted by other electronic devices.

Within electronic device 1000, processing subsystem 1010, memory subsystem 1012, and networking subsystem 1014 are coupled together using bus 1028. Bus 1028 may include an electrical, optical, and/or electro-optical connection that the subsystems can use to communicate commands and data among one another. Although only one bus 1028 is shown for clarity, different embodiments can include a different number or configuration of electrical, optical, and/or electro-optical connections among the subsystems.

In some embodiments, electronic device 1000 includes a display subsystem 1026 for displaying information on a display, which may include a display driver and the display, such as a liquid-crystal display, a multi-touch touchscreen, etc.

Electronic device 1000 can be (or can be included in) any electronic device with at least one network interface. For example, electronic device 1000 can be (or can be included in): a desktop computer, a laptop computer, a subnotebook/netbook, a server, a computer, a mainframe computer, a cloud-based computer, a tablet computer, a smartphone, a cellular telephone, a smartwatch, a consumer-electronic device, a portable computing device, an access point, a transceiver, a controller, a radio node, a router, a switch, communication equipment, test equipment, and/or another electronic device.

Although specific components are used to describe electronic device 1000, in alternative embodiments, different components and/or subsystems may be present in electronic device 1000. For example, electronic device 1000 may include one or more additional processing subsystems, memory subsystems, networking subsystems, and/or display subsystems. Additionally, one or more of the subsystems may not be present in electronic device 1000. Moreover, in some embodiments, electronic device 1000 may include one or more additional subsystems that are not shown in FIG. 10. Also, although separate subsystems are shown in FIG. 10, in some embodiments some or all of a given subsystem or component can be integrated into one or more of the other subsystems or component(s) in electronic device 1000. For example, in some embodiments program instructions 1022 is included in operating system 1024 and/or control logic 1016 is included in interface circuit 1018.

Moreover, the circuits and components in electronic device 1000 may be implemented using any combination of analog and/or digital circuitry, including: bipolar, PMOS and/or NMOS gates or transistors. Furthermore, signals in these embodiments may include digital signals that have approximately discrete values and/or analog signals that have continuous values. Additionally, components and circuits may be single-ended or differential, and power supplies may be unipolar or bipolar.

An integrated circuit (which is sometimes referred to as a 'communication circuit' or a 'means for communication') may implement some or all of the functionality of networking subsystem 1014. The integrated circuit may include hardware and/or software mechanisms that are used for transmitting wireless signals from electronic device 1000 and receiving signals at electronic device 1000 from other electronic devices. Aside from the mechanisms herein described, radios are generally known in the art and hence are not described in detail. In general, networking subsystem 1014 and/or the integrated circuit can include any number of radios. Note that the radios in multiple-radio embodiments function in a similar way to the described single-radio embodiments.

In some embodiments, networking subsystem 1014 and/or the integrated circuit include a configuration mechanism (such as one or more hardware and/or software mechanisms) that configures the radio(s) to transmit and/or receive on a given communication channel (e.g., a given carrier frequency). For example, in some embodiments, the configuration mechanism can be used to switch the radio from monitoring and/or transmitting on a given communication channel to monitoring and/or transmitting on a different communication channel. (Note that 'monitoring' as used herein comprises receiving signals from other electronic devices and possibly performing one or more processing operations on the received signals)

In some embodiments, an output of a process for designing the integrated circuit, or a portion of the integrated circuit, which includes one or more of the circuits described herein may be a computer-readable medium such as, for example, a magnetic tape or an optical or magnetic disk. The computer-readable medium may be encoded with data structures or other information describing circuitry that may be physically instantiated as the integrated circuit or the portion of the integrated circuit. Although various formats may be used for such encoding, these data structures are commonly written in: Caltech Intermediate Format (CIF), Calma GDS II Stream Format (GDSII) or Electronic Design Interchange Format (EDIF), OpenAccess (OA), or Open Artwork System Interchange Standard (OASIS). Those of skill in the art of integrated circuit design can develop such data structures from schematics of the type detailed above and the corresponding descriptions and encode the data structures on the computer-readable medium. Those of skill in the art of integrated circuit fabrication can use such encoded data to fabricate integrated circuits that include one or more of the circuits described herein.

While the preceding discussion used Wi-Fi and/or Ethernet communication protocols as illustrative examples, in other embodiments a wide variety of communication protocols and, more generally, communication techniques may be used. Thus, the communication techniques may be used in a variety of network interfaces. Furthermore, while some of the operations in the preceding embodiments were implemented in hardware or software, in general the operations in the preceding embodiments can be implemented in a wide variety of configurations and architectures. Therefore, some or all of the operations in the preceding embodiments may be performed in hardware, in software or both. For example, at least some of the operations in the communication techniques may be implemented using program instructions 1022, operating system 1024 (such as a driver for interface circuit 1018) or in firmware in interface circuit 1018. Alternatively or additionally, at least some of the operations in the communication techniques may be implemented in a physical layer, such as hardware in interface circuit 1018.

Moreover, while the preceding embodiments illustrated the use of wireless signals in one or more bands of frequencies, in other embodiments of these signals may be communicated in one or more different bands of frequencies, including: a microwave frequency band, a radar frequency band, 600 MHz, 2.4 GHz, 5 GHz, 6 GHz, 60 GHz, and/or a band of frequencies used by a Citizens Broadband Radio Service (CBRS) or by LTE. In some embodiments, the communication between electronic devices uses multi-user transmission (such as orthogonal frequency division multiple access or OFDMA).

Furthermore, while the preceding embodiments illustrated the communication techniques with an access point, in other embodiments the communication techniques may be used with a wide variety of electronic devices, including: a desktop computer, a laptop computer, a subnotebook/netbook, a server, a computer, a mainframe computer, a cloud-based computer, a tablet computer, a smartphone, a cellular telephone, a smartwatch, a consumer-electronic device, a portable computing device, a transceiver, a controller, a radio node (e.g., an eNodeB), a router, a switch, communication equipment, a base station, test equipment, and/or another electronic device.

In the preceding description, we refer to 'some embodiments.' Note that 'some embodiments' describes a subset of all of the possible embodiments, but does not always specify the same subset of embodiments. Moreover, note that numerical values in the preceding embodiments are illustrative examples of some embodiments. In other embodiments of the communication techniques, different numerical values may be used.

The foregoing description is intended to enable any person skilled in the art to make and use the disclosure, and is provided in the context of a particular application and its requirements. Moreover, the foregoing descriptions of embodiments of the present disclosure have been presented for purposes of illustration and description only. They are not intended to be exhaustive or to limit the present disclosure to the forms disclosed. Accordingly, many modifications and variations will be apparent to practitioners skilled in the art, and the general principles defined herein may be applied to other embodiments and applications without departing from the spirit and scope of the present disclosure. Additionally, the discussion of the preceding embodiments is not intended to limit the present disclosure. Thus, the present disclosure is not intended to be limited to the embodiments shown, but is to be accorded the widest scope consistent with the principles and features disclosed herein.

What is claimed is:

1. An electronic device, comprising: an interface circuit; a first pair of antennas having a first polarization along a first direction in a plane, wherein the first pair of antennas have a first spatial offset from each other along a second direction in the plane; a second pair of antennas having a second polarization along the second direction, wherein the second pair of antennas have a second spatial offset from each other along the first direction; and switching elements configured to selectively perform operations comprising: selecting the first pair of antennas and electrically coupling the second pair of antennas to ground; or selecting the second pair of antennas and electrically coupling the first pair of antennas to ground; and wherein the interface circuit is configured to: provide control signals to the switching elements to selectively perform the operations, wherein the selective performing of the operations modifies an antenna radiation pattern of the electronic device, and wherein the first pair of antennas are configured to resonate at a lower frequency than the second pair of antennas and, when a given first antenna in the first pair of antennas is selectively electrically coupled to ground, the given first antenna is configured to act as a reflector to modify the antenna pattern associated with a given second antenna in the second pair of antennas; and communicate with a second electronic device via the selected first pair of antennas or the second pair of antennas, wherein the communication comprises transmitting or receiving wireless signals corresponding to a packet or a frame.

2. The electronic device of claim 1, wherein a given first antenna in the first pair of antennas or a given second antenna in the second pair of antennas comprises a dipole antenna.

3. The electronic device of claim 1, wherein, when selected, the first pair of antennas or the second pair of antennas are electrically coupled, via a subset of the switching elements, to a feed port by vertical parallel plate transmission lines.

4. The electronic device of claim 3, wherein a given vertical parallel plate transmission line is configured to provide impedance matching for a given first antenna in the first pair of antennas or a given second antenna in the second pair of antennas.

5. The electronic device of claim 1, wherein the first direction is perpendicular to the second direction.

6. The electronic device of claim 1, wherein the first polarization or the second polarization comprises a horizontal polarization.

7. The electronic device of claim 1, further comprising a set of first antennas and a set of second antennas, wherein the set of first antennas comprises multiple instances of the first pair of antennas, which include the first pair of antennas;

wherein different instances of the first pair of antennas are spatially offset from each other along the second direction;

wherein the set of second antennas comprises multiple instances of the second pair of antennas, which include the second pair of antennas; and wherein different instances of the second pair of antennas are spatially offset from each other along the first direction.

8. The electronic device of claim 1, wherein the first pair of antennas and the second pair of antennas are configured to operate in two bands of frequencies.

9. The electronic device of claim 1, wherein, a base of a given first antenna in the first pair of antennas and a given second antenna in the second pair of antennas is coupled to a substrate, while a remainder of the given first antenna and the given second antenna is free-standing.

10. The electronic device of claim 1, wherein the switching elements comprise: a radio-frequency switch; or a PIN diode.

11. The electronic device of claim 1, wherein, after selecting the first pair of antennas or the second pair of antennas, the interface circuit is configured to further modify the antenna pattern of the electronic device.

12. The electronic device of claim 11, wherein the further modification is performed using an adaptive reflector, an adaptive director, or both.

13. The electronic device of claim 11, wherein the further modification is performed by selectively electrically coupling antenna elements in a given first antenna in the first pair of antennas or a given second antenna in the second pair of antennas to ground.

14. A non-transitory computer-readable storage medium for use in conjunction with an electronic device, the computer-readable storage medium storing program instructions, wherein, when executed by the electronic device, the program instructions cause the electronic device to perform operations comprising: configuring switching elements to: select a first pair of antennas and electrically coupling a second pair of antennas to ground; or select the second pair of antennas and electrically coupling the first pair of antennas to ground, wherein the first pair of antennas have a first polarization along a first direction in a plane and the first pair of antennas have a first spatial offset from each other along a second direction in the plane, wherein the second pair of antennas have a second polarization along the second direction and the second pair of antennas have a second spatial offset from each other along the first direction, wherein selecting the first pair of antennas or the second pair of antennas modifies an antenna pattern of the electronic device, and wherein the first pair of antennas resonate at a lower frequency that than the second pair of antennas and, when a given first antenna in the first pair of antennas is selectively electrically coupled to ground, the given first antenna acts as a reflector to modify the antenna pattern associated with a given second antenna in the second pair of antennas; and communicating with a second electronic device via the selected first pair of antennas or the second pair of antennas, wherein the communication comprises transmitting or receiving wireless signals corresponding to a packet or a frame.

15. A method for communicating a packet or a frame, comprising: by an electronic device: configuring switching elements to: select a first pair of antennas and electrically coupling a second pair of antennas to ground; or select the second pair of antennas and electrically coupling the first pair of antennas to ground, wherein the first pair of antennas have a first polarization along a first direction in a plane and the first pair of antennas have a first spatial offset from each other along a second direction in the plane, wherein the second pair of antennas have a second polarization along the second direction and the second pair of antennas have a second spatial offset from each other along the first direction, wherein selecting the first pair of antennas or the second pair of antennas modifies an antenna pattern of the electronic device, and wherein the first pair of antennas resonate at a lower frequency than the second pair of antennas and, when a given first antenna in the first pair of antennas is selectively electrically coupled to ground, the given first antenna acts as a reflector to modify the antenna pattern associated with a given second antenna in the second pair of antennas; and communicating with a second electronic device via the selected first pair of antennas or the second pair of antennas, wherein the communication comprises transmitting or receiving wireless signals corresponding to the packet or the frame.

16. The method of claim 15, wherein the first direction is perpendicular to the second direction.

17. The method of claim 15, wherein the first polarization or the second polarization comprises a horizontal polarization.

18. The method of claim 15, wherein, after selecting the first pair of antennas or the second pair of antennas, the method comprises further modifying the antenna pattern of the electronic device.

19. The method of claim 18, wherein the further modification is performed using an adaptive reflector, an adaptive director, or both.

20. The method of claim 18, wherein the further modification is performed by selectively electrically coupling antenna elements in a given first antenna in the first pair of antennas or a given second antenna in the second pair of antennas to ground.

* * * * *